US009289068B1

(12) United States Patent
Shokouhi

(10) Patent No.: US 9,289,068 B1
(45) Date of Patent: Mar. 22, 2016

(54) MODULAR STACKABLE STOOL SYSTEMS

(71) Applicant: Chameleon Chairs LLC, Torrance, CA (US)

(72) Inventor: Behshad Shokouhi, Sherman Oaks, CA (US)

(73) Assignee: Chameleon Chairs LLC, Inglewood, CA (US)

( * ) Notice: Subject to any disclaimer, the term of this patent is extended or adjusted under 35 U.S.C. 154(b) by 68 days.

(21) Appl. No.: 13/747,673

(22) Filed: Jan. 23, 2013

Related U.S. Application Data

(60) Provisional application No. 61/646,185, filed on May 11, 2012, provisional application No. 61/590,654, filed on Jan. 25, 2012.

(51) Int. Cl.
*A47C 3/04* (2006.01)
*A47C 4/02* (2006.01)

(52) U.S. Cl.
CPC .... *A47C 3/04* (2013.01); *A47C 4/02* (2013.01)

(58) Field of Classification Search
USPC ..... 297/239, 423.1, 440.22, 461, 440.14, 297/440.1
See application file for complete search history.

(56) References Cited

U.S. PATENT DOCUMENTS 1,026,759 A * 5/1912 Meeker ..... 108/127
2,184,470 A 12/1939 Primavera
2,628,668 A 2/1953 Basile
2,843,435 A 7/1958 Hoven et al.
2,940,597 A 6/1960 Machielse et al.
2,961,037 A 11/1960 Keefer
3,057,661 A 10/1962 Moxley
3,407,001 A 10/1968 Minsker
3,756,062 A 9/1973 Merola
3,847,433 A 11/1974 Acton et al.
4,254,992 A 3/1981 Orosa
4,304,436 A 12/1981 Rowland
4,456,296 A 6/1984 Rowland
4,974,906 A 12/1990 Hines
5,174,548 A 12/1992 Mueller
5,626,394 A 5/1997 Perry
5,632,524 A 5/1997 Ikeda et al.
5,690,380 A 11/1997 Waters
5,762,396 A 6/1998 Barile
5,775,778 A 7/1998 Riley et al.
5,779,317 A 7/1998 Neal
5,957,528 A 9/1999 Campbell
6,089,522 A 7/2000 Haslem et al.
6,135,562 A * 10/2000 Infanti ..... 297/440.2
6,428,098 B1 8/2002 Allbaugh
6,637,823 B1 10/2003 Ursini et al.
6,669,281 B1 12/2003 Huang
6,837,542 B2 1/2005 Barile, Jr. et al.
6,899,396 B2 5/2005 Bales
7,011,367 B2 3/2006 Riley
7,118,175 B2 * 10/2006 Crue ..... 297/239

(Continued)

FOREIGN PATENT DOCUMENTS

EP 0455565 A1 11/1991
FR 2565475 A1 * 12/1985 ..... A47C 13/00
FR 2586916 A3 10/2011

*Primary Examiner* — David R Dunn
*Assistant Examiner* — Jody Giacoman
(74) *Attorney, Agent, or Firm* — Lodestar Patents, PLLC; Raymond J. E. Hall

(57) ABSTRACT

A modular stackable stool system providing stackable bar stools that may be selectively customized by interchanging of the base supports and seats.

18 Claims, 11 Drawing Sheets

(56) References Cited

U.S. PATENT DOCUMENTS

| | | | | |
|---|---|---|---|---|
| 7,147,286 | B2 | 12/2006 | Cesaroni et al. | |
| 7,240,964 | B2 | 7/2007 | Riley | |
| 7,469,962 | B2 | 12/2008 | Paulin | |
| 7,722,123 | B2 * | 5/2010 | Holland | 297/440.1 |
| 8,047,607 | B1 * | 11/2011 | Shokouhi et al. | 297/239 |
| 2001/0005070 | A1 | 6/2001 | Kemnitzer | |
| 2003/0090137 | A1 | 5/2003 | Piretti | |
| 2003/0164602 | A1 | 9/2003 | Kuhlman | |
| 2003/0164639 | A1 | 9/2003 | Infanti | |
| 2003/0209925 | A1 | 11/2003 | Bosman et al. | |
| 2005/0151409 | A1 * | 7/2005 | Infanti et al. | 297/440.2 |
| 2008/0093909 | A1 * | 4/2008 | Deng | 297/440.15 |
| 2008/0143166 | A1 * | 6/2008 | de Oliveira | 297/440.14 |
| 2011/0073723 | A1 * | 3/2011 | Ashpole | 248/176.2 |

* cited by examiner

MODULAR STACKABLE STOOL SYSTEMS

CROSS-REFERENCE TO RELATED APPLICATION

The present application is related to and claims priority from prior provisional application Ser. No. 61/646,185, filed May 11, 2012, entitled "MODULAR STACKABLE STOOL SYSTEMS"; and, this application is related to and claims priority from prior provisional application Ser. No. 61/590,654, filed Jan. 25, 2012, entitled "MODULAR STACKABLE STOOL SYSTEMS"; the contents of all of which are incorporated herein by this reference and are not admitted to be prior art with respect to the present invention by the mention in this cross-reference section.

BACKGROUND

This invention relates to providing a modular stacking stool system. More particularly, this invention relates to providing a system of stackable bar stools that may be selectively customized by interchanging of the base supports and seats.

No system exists that permits furniture renters to fill diverse customer orders from a small stock of modular bar stool components and seats. No commercial rental bar stools exist that can be easily, inexpensively, and modularly repaired, updated, stored, and transported. Therefore, a need exists for a modular stackable furniture system that permits furniture renters to fill diverse customer orders from a small stock of modular components, including custom "themed" designs. Further, a need exists for commercial rental stools that can be easily, inexpensively, and modularly repaired, updated, stored, and transported.

OBJECTS AND FEATURES OF THE INVENTION

A primary object and feature of the present invention is to provide a system overcoming the above-mentioned problem (s).

It is a further object and feature of the present invention to provide such a system comprised of stackable bar stools that may be selectively customized by interchanging of the base supports and seat cushions.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a modular stool system relating to modular stool components capable of forming distinct sets of themed stools, such modular stool system comprising: at least one first set of stool bases, each such stool base of such at least one first set of stool bases comprising at least one first common base feature; at least one first set of stool seats, each such stool seat of such at least one first set of stool seats comprising at least one first common seat feature; and at least one second set of stool seats, each such stool seat of such at least one second set of stool seats comprising at least one second common seat feature differing from such at least one first common seat feature; wherein each stool seat of such at least one first set of stool seats and such at least one second set of stool seats is configured to be supportable by each such stool base of such at least one first set of stool bases; wherein each such stool seat of such at least one first set of stool seats and each such stool seat of such at least one second set of stool seats comprise at least one first coupling element structured and arranged to releasably couple with at least one second coupling element of at least one such stool base of such at least one first set of stool bases. Wherein each such stool base of such at least one first set of stool bases further comprises at least three support legs structured and arranged to support, above at least one support surface, a selected one of each such stool seat of such at least one first set of stool seats and each such stool seat of such at least one second set of stool seats, such at least one second coupling element structured and arranged to releasably engage such at least one first coupling element of each such stool seat of either one of such at least one first set of stool seats and such at least one second set of stool seats, and extending between two of such at least three support legs, a mono-directional foot rest configure to support at least one foot of a user; wherein, when detached from such stool seat, each such stool base of such at least one first set of stool bases nesting-stacking with each other such stool base of such at least one first set of stool bases.

Moreover, it provides such a modular stool system further comprising: at least one second set of stool bases, each such stool base of such at least one second set of stool bases comprising at least one second common base feature differing from such at least one first common base feature; wherein each stool seat of such at least one first set of stool seats and such at least one second set of stool seats is configured to be supportable by each such stool base of either one of such at least one first set of stool bases and each such stool base of such at least one second set of stool bases; wherein each such stool seat of such at least one first set of stool seats and each such stool seat of such at least one second set of stool seats comprise such at least one first coupling element structured and arranged to couple with such at least one second coupling element of at least one such stool base of either one of such at least one first set of stool bases and such at least one second set of stool bases; wherein each such stool base of such at least one second set of stool bases further comprise at least three such support legs structured and arranged to support, above such at least one support surface, a selected one of each such stool seat of such at least one first set of stool seats and each such stool seat of such at least one second set of stool seats, such at least one second coupling element structured and arranged to engage such at least one first coupling element of each such stool seat of either one of such at least one first set of stool seats and such at least one second set of stool seats, and extending between two of such at least three support legs, such mono-directional foot rest configure to support the at least one foot of the user; wherein, when detached from such stool seat, each such stool base of such at least one first set of stool bases allow nesting-stacking with each such stool base of either such at least one first set of stool bases and such at least one second set of stool bases.

Additionally, it provides such a modular stool system wherein each one of such at least three support legs comprises a continuous curve. Also, it provides such a modular stool system further comprising four of such at least three support legs. In addition, it provides such a modular stool system wherein such stool seat substantially comprises: at least one substantially rigid base; at least one resilient foam; and at least one fabric material at least partially encasing such at least one resilient foam and such at least one substantially rigid base. And, it provides such a modular stool system wherein each such stool base is constructed substantially of at least one rigid metallic material. Further, it provides such a modular stool system wherein such at least one rigid metallic material comprises substantially steel. Even further, it provides such a modular stool system wherein each such stool base comprises a maximum stool-base height of about 26 inches. Even further, it provides such a modular stool system wherein each such stool base comprises a maximum contact width of about 18 inches. Even further, it provides such a modular stool system wherein such at least one first coupling element and such at least one second coupling element comprise at least one hook-and-loop fastener.

In accordance with another preferred embodiment hereof, this invention provides a method relating to forming distinct sets of themed stools from modular stool components, such method comprising the steps of: providing at least one set of modular stool bases comprising multiple stool-base themes; providing at least one set of modular stool seats comprising multiple stool-seat themes; configuring each stool seat of such at least one set of modular stool seats to be supportable by each such stool base of such at least one set of modular stool bases; configuring each stool seat of such at least one set of modular stool seats to comprise at least one first coupling element structured and arranged to couple with at least one second coupling element of at least one such stool base; configuring each such stool base of such at least one set of modular stool bases to comprise such at least one second coupling element structured and arranged to engage such at least one first coupling element of each such stool seat; configuring each such stool base of such at least one set of modular stool bases to comprise at least three support legs structured and arranged to support, above at least one support surface, a selected one of such at least one set of modular stool seats, configuring each such stool base of such at least one set of modular stool bases to comprise, extending between two of such at least three support legs, a mono-directional foot rest configure to support the at least one foot of a user; and wherein at least one distinct set of stools, comprising a distinct stool theme, may be developed by combining such stool seats selected from such at least one set of modular stool seats with such at least one stool bases selected from such at least one set of modular stool bases.

Even further, it provides such a method further comprising the steps of configuring such stool bases to allow for compact nesting-stacking of a plurality of such stool bases when such stool bases are detached from such stool seats. In accordance with another preferred embodiment hereof, this invention provides a modular stool system relating to modular stool components capable of forming distinct sets of themed stools, such modular stool system comprising: at least one set of modular stool bases comprising multiple stool-base themes; at least one set of modular stool seats comprising multiple stool-seat themes; wherein each stool seat of such at least one set of modular stool seats is configured to be detachably coupled to a selected stool base of such at least one set of modular stool bases; wherein each such stool base comprises at least three support legs following a continuous curve, and extending between two of such at least three support legs, a mono-directional foot rest configure to support the at least one foot of a user; wherein at least one distinct set of stools, comprising a distinct stool theme, may be developed by combining such stool seats selected from such at least one set of modular stool seats with such at least one stool bases selected from such at least one set of modular stool bases. Even further, it provides such a modular stool system wherein such stool seat substantially comprises: at least one substantially rigid base; at least one resilient foam; and, at least one fabric material at least partially encasing such at least one resilient foam and such at least one substantially rigid base. Even further, it provides such a modular stool system wherein each such stool base is constructed substantially of at least one rigid metallic material.

Even further, it provides such a modular stool system wherein such at least one rigid metallic material comprises substantially steel. Even further, it provides such a modular stool system wherein each such stool base comprises a maximum stool-base height of about 26 inches. Even further, it provides such a modular stool system wherein each such stool base comprises a maximum contact width of about 18 inches. Even further, it provides such a modular stool system further comprising: joined with such stool seat, at least one first releasable coupler; joined with such stool base, at least one second releasable coupler; wherein such at least one first releasable coupler and such at least one second releasable coupler comprise at least one hook-and-loop fastener.

According to preferred embodiments of the present invention, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
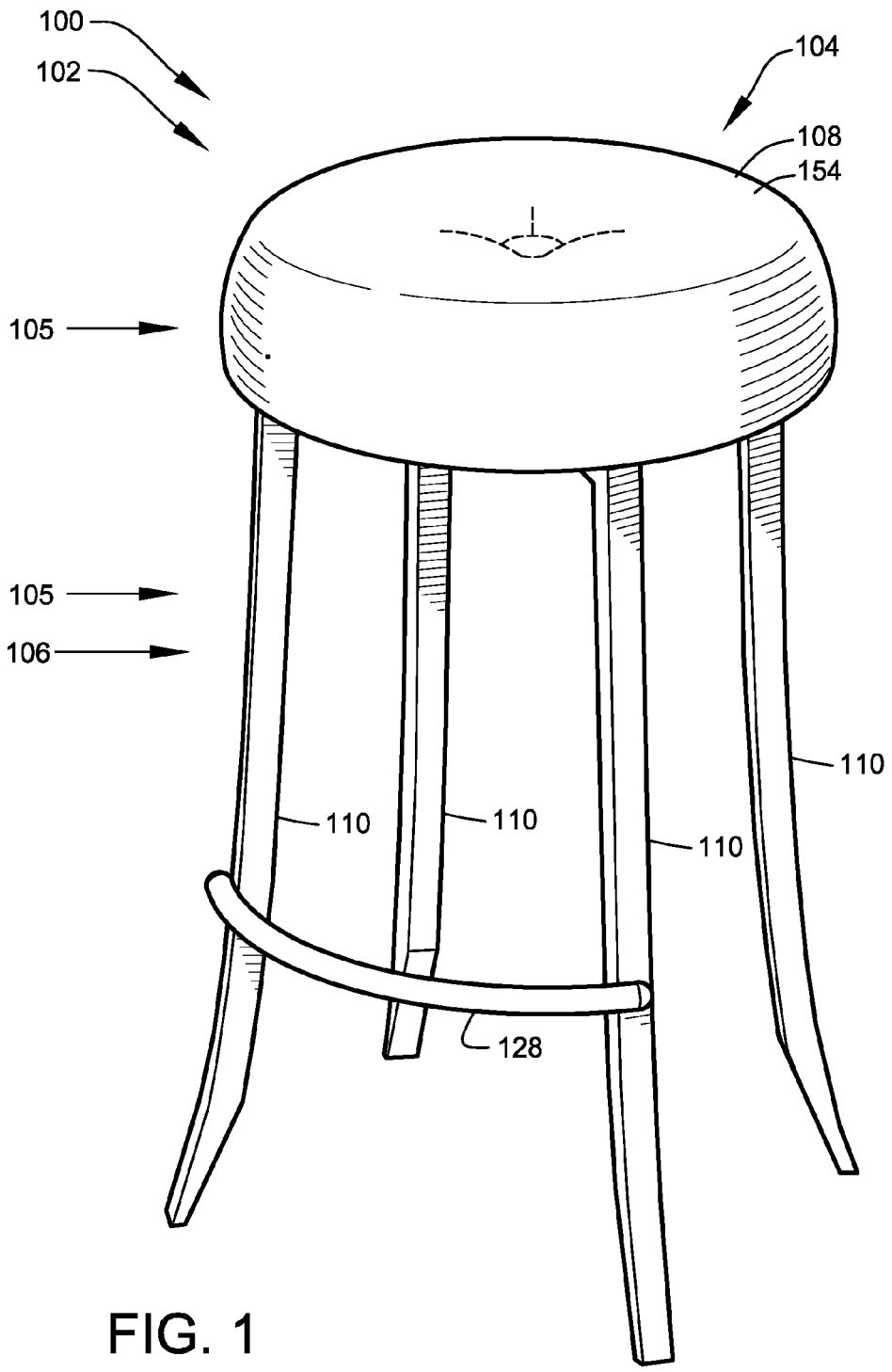
FIG. 1 shows a perspective view illustrating modular stackable stool according to a preferred embodiment of the present invention.
Figure 2:
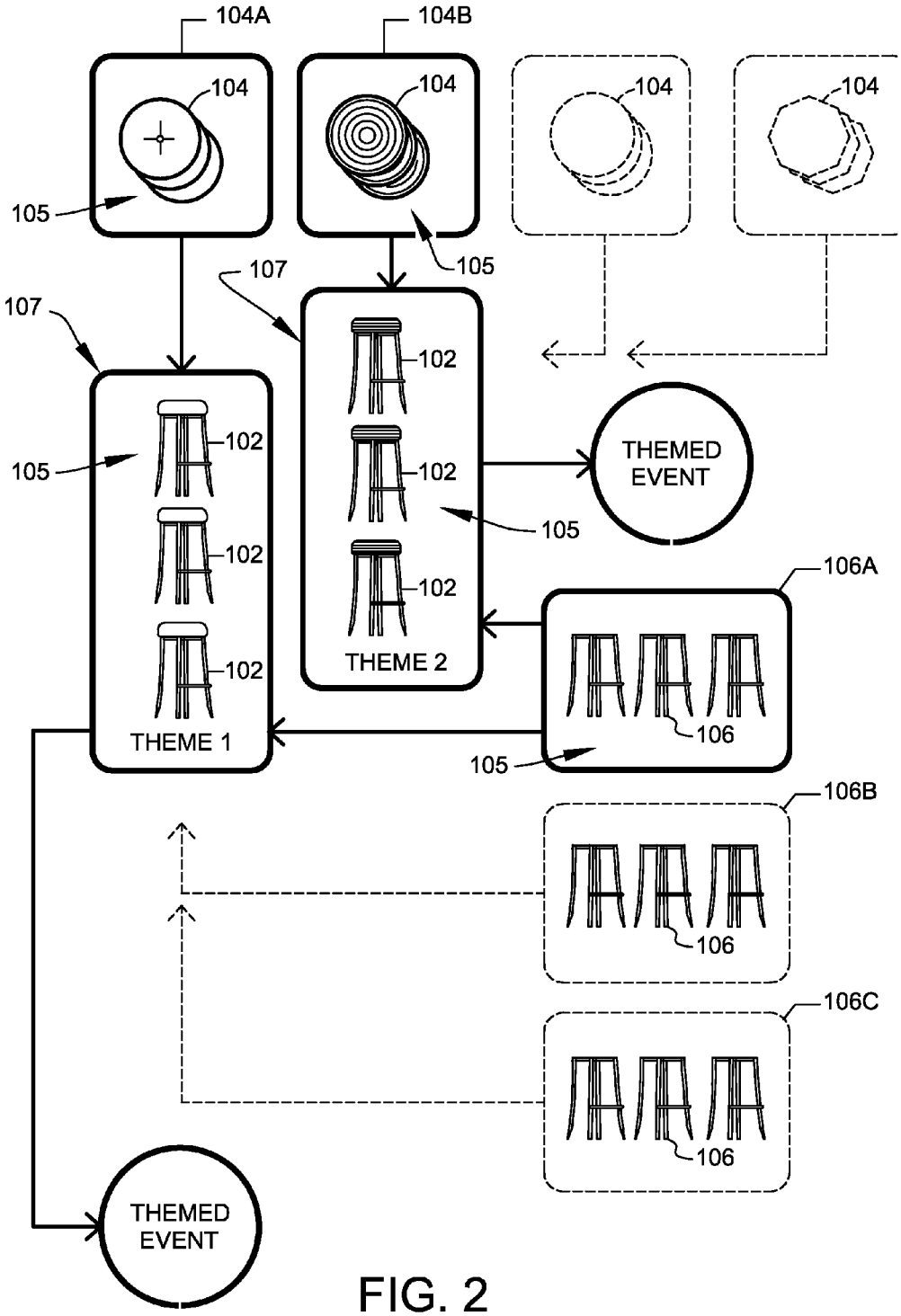
FIG. 2 is a diagram, illustrating sets of distinctly themed stools generated from sets of modular stool components, according to preferred methods and embodiments of the present invention.

FIG. 1 shows a perspective view illustrating a modular stackable stool 102 according to a preferred embodiment of modular stackable stool system 100. FIG. 2 is a diagram, schematically illustrating sets of distinctly themed stools 102 generated from sets of modular stool components 105, according to preferred methods and embodiments of the present invention. Within modular stackable stool system 100, multiple distinct sets of bar-type stool embodiments can be developed by combining selected stool bases 106 with selected stool seats 104. The resulting stools 102 preferably comprise a common stool theme 107; for example, a common stool-seat shape, a common color theme, a common finish, etc. Preferred themes may also comprise a particular design motif or established style. Examples of possible design motifs or styles that may be developed within the present system include classical/traditional, contemporary, etc. In general, development of such a design motif or style within a modular component is preferably accomplished by the application of appropriate physical detailing associated with such design motif or style, such as, for example, selection of shape and line, component proportions, color selections, upholstery-fabric patterning, ornamentation, etc.

FIG. 2 diagrammatically illustrates how a distinct set of "themed" stools 102 may be generated from sets of pre-existing modular stool components 105. The present invention is preferably designed to permit an event-furniture renter to offer, to event customers, many distinct stool design options, preferably by assembling "themed" stools 102 from a small stock of modular stool components 105. Furthermore, it will be described how such small stock of modular stool components 105 are preferably adapted to be compactly-stored between uses.

In a representative example illustrating the preferred features of the system, an event-furniture renter stocks at least one first set of stool bases 106A, as shown. Alternately preferably, the event-furniture renter stocks both the first set of stool bases 106A and at least one second stock of stool bases 106B, as shown. Each stool base 106A of the renter's first set comprises one or more common base features (i.e., a common color, finish, etc.) If applicable, each of the renter's second set of stool bases 106B also preferably comprise one or more common base features; however, the common base features of stool bases 106B preferably differ from the common base features of the first set of stool bases 106A.

In a similar manner, the event-furniture renter preferably stocks at least one first set of stool seats 104A and at least one second set of stool seats 104B, as shown. Each stool seat 104A of the renter's first set comprises one or more common seat features (i.e., a common color, upholstery finish, shape, etc.) Each of the renter's second set of stool seats 104B also preferably comprise one or more common seat features; however, the common seat features of stool seats 104B preferably differ from the common seat features of the first set of stool seats 104A.

To fill a rental order for stools 102 comprising a single distinct stool theme 107, the event-furniture renter preferably combines stool seats 104 selected from one of the at least two sets of stool seats with stool bases 106 selected from one of the at least two sets of stool bases. All stool seats 104A and stool seats 104B are preferably configured to be compatible with (that is, supportable by) any selected stool bases 106A or stool bases 106B of either of the first or second stool-base sets.

It should be noted that the system is fully enabled by the event-furniture renter's acquisition of a single uniform stock of stool bases 106A; however, acquisition of the second stock of stool bases 106B, comprising a differing appearance form the first set, further enhances the preferred customization options offered by the present system.

Figure 12:
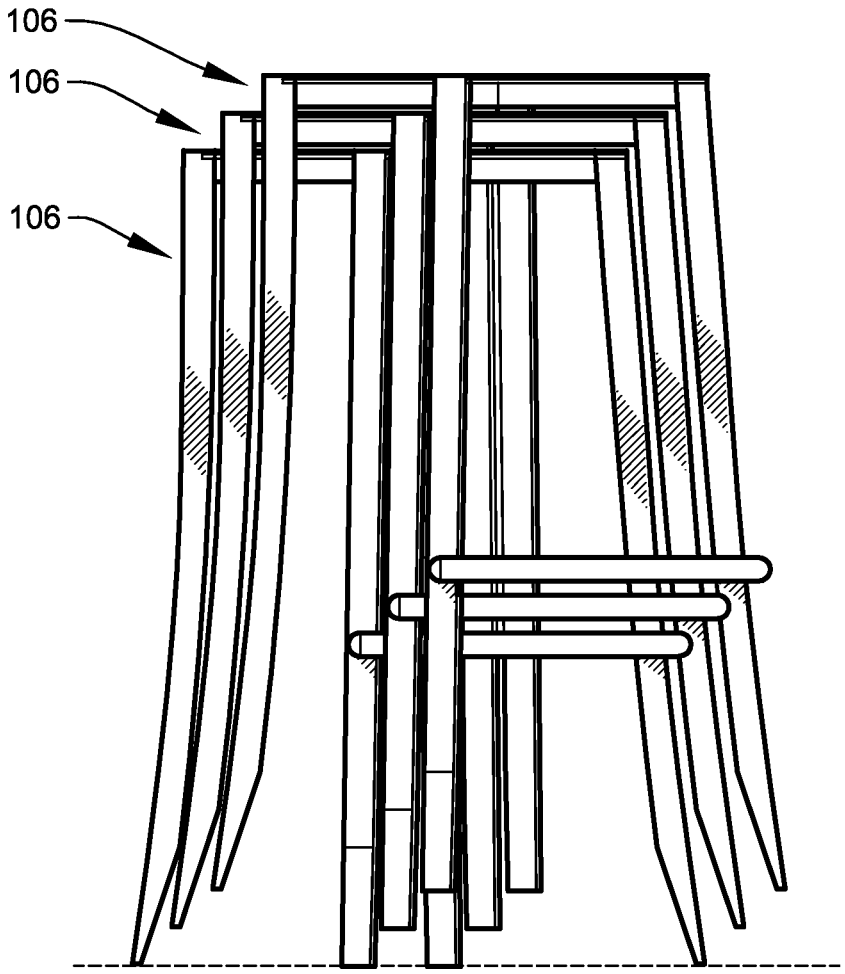
FIG. 12 is a side view of a "nesting-stacked" arrangement of modular stackable stool bases, according to preferred embodiments of the present invention.

When not in use, stool bases 106A of the first set of stool bases may be nesting-stacked, as shown in FIG. 12. Preferably, stool bases 106A and stool bases 106B of either of the first and second sets of stool bases may be nesting-stacked, as shown in FIG. 12. Preferably, stool seats 104 may be stacked separately or otherwise stored. Each stack preferably comprise a minimum of six (up to eight) stool bases 106. Stacking stool bases offers significant benefits in terms of protecting the product, minimizing handling costs, and minimizing storage space requirements. Upon reading this specification, those with ordinary skill in the art will now appreciate that, under appropriate circumstances, considering such issues as design preference, user preferences, marketing preferences, cost, structural requirements, available materials, technological advances, etc., other system arrangements such as, for example, storing stool seats within a custom-designed transport unit, etc., may suffice. Furthermore, those with ordinary skill in the art, upon reading this specification, will now appreciate that, under appropriate circumstances, considering such issues as design preference, user preferences, marketing preferences, cost, structural requirements, available materials, technological advances, etc., other features/arrangements such as, for example, providing such custom-designed transport units, transport dollies, etc., may suffice.

Figure 3:
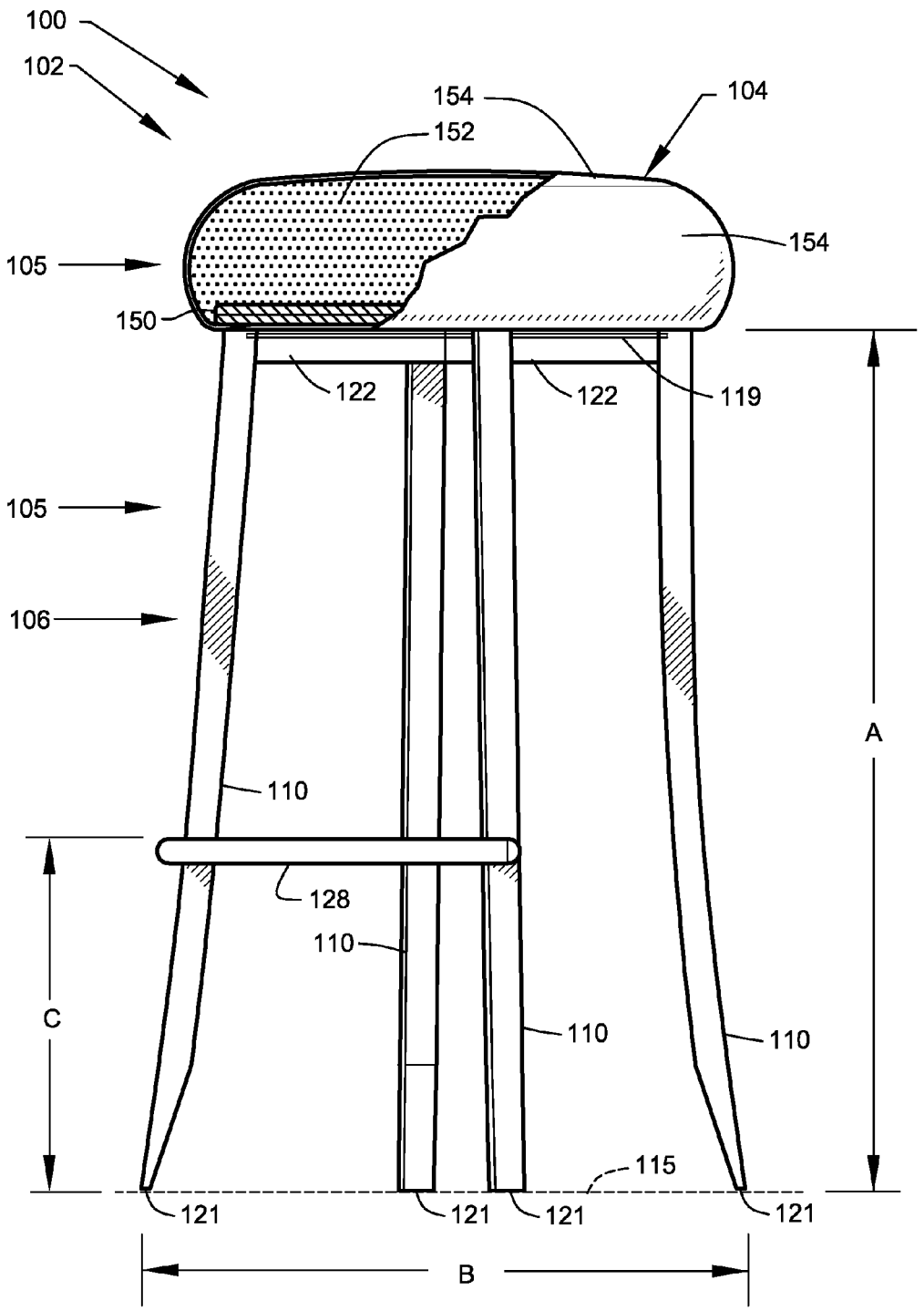
FIG. 3 is a front view of the modular stackable stool of FIG. 1, the rear view, the right-side view and the left-side view being symmetrically identical.
Figure 4:
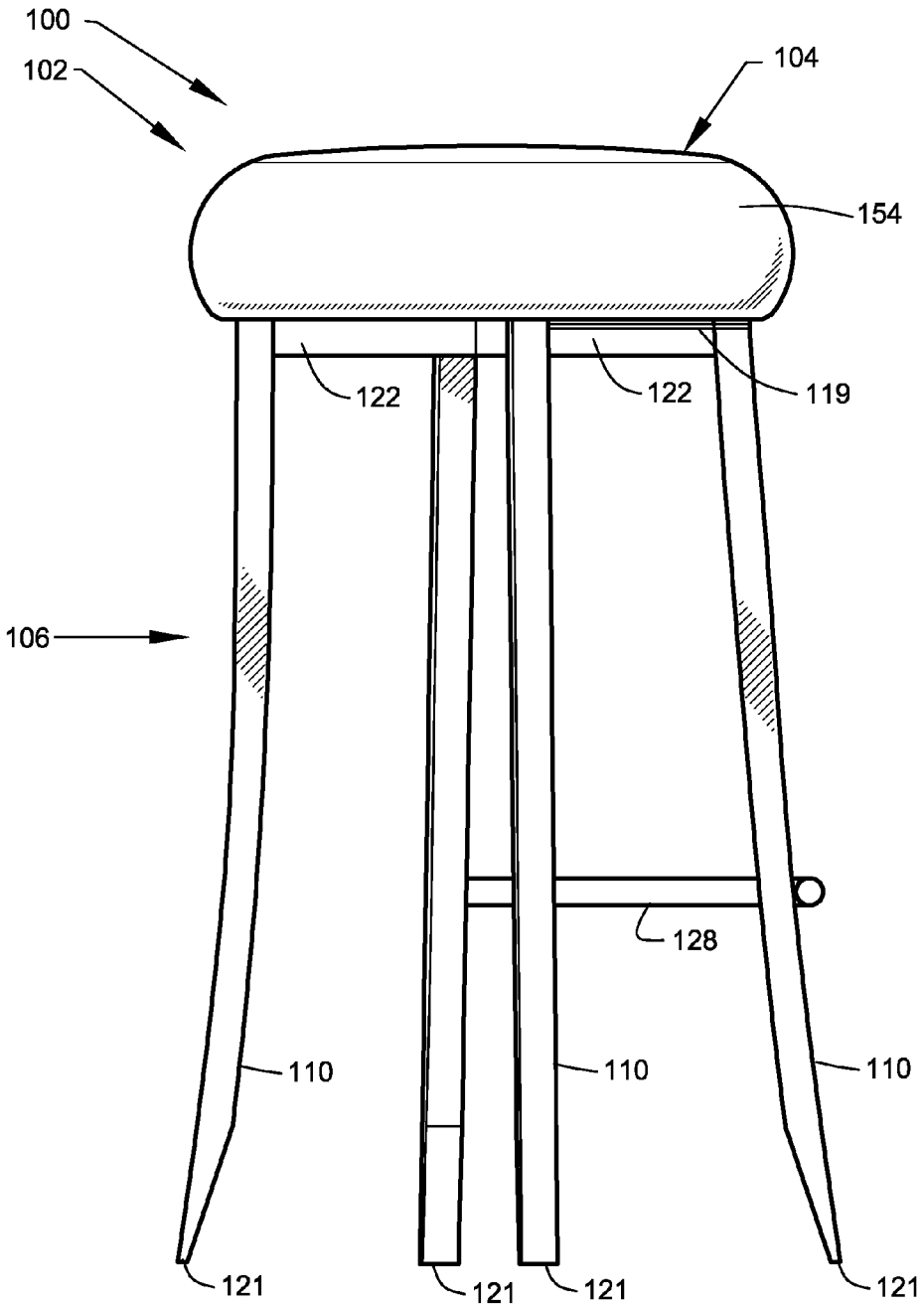
FIG. 4 is a rear view of the modular stackable stool of FIG. 1.
Figure 5:
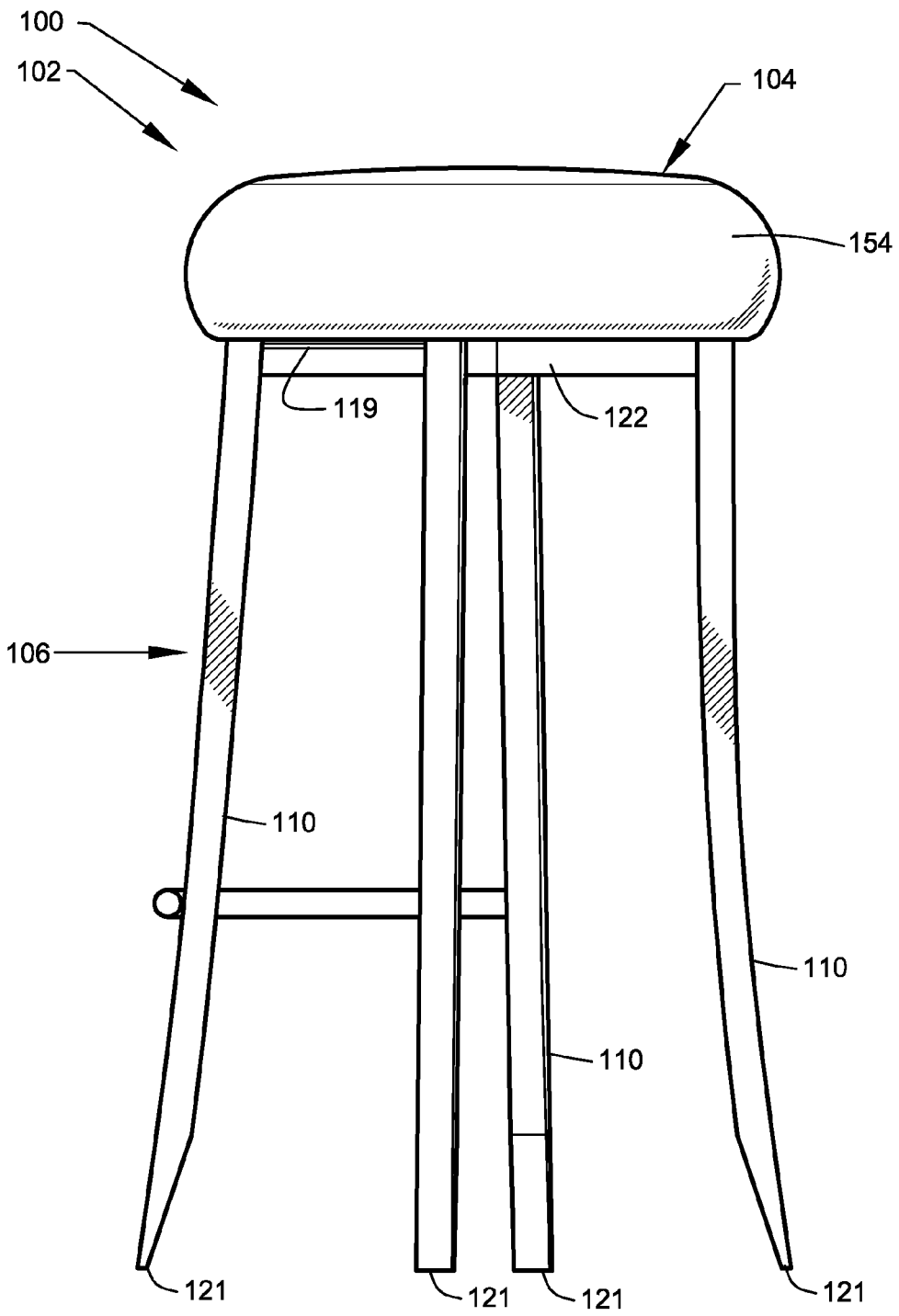
FIG. 5 is a right side view of the modular stackable stool of FIG. 1.
Figure 6:
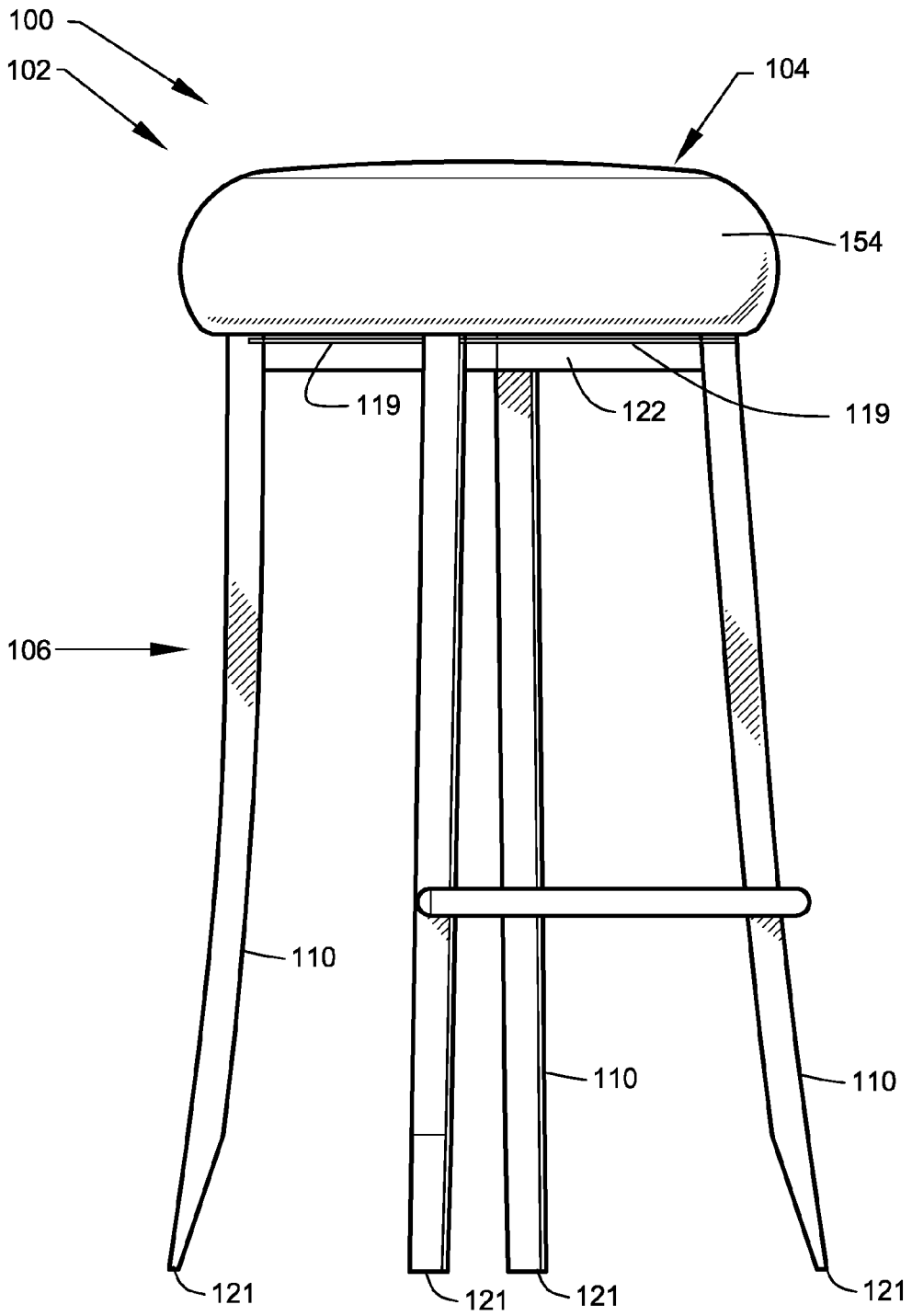
FIG. 6 is a left side view of the modular stackable stool of FIG. 1.
Figure 7:
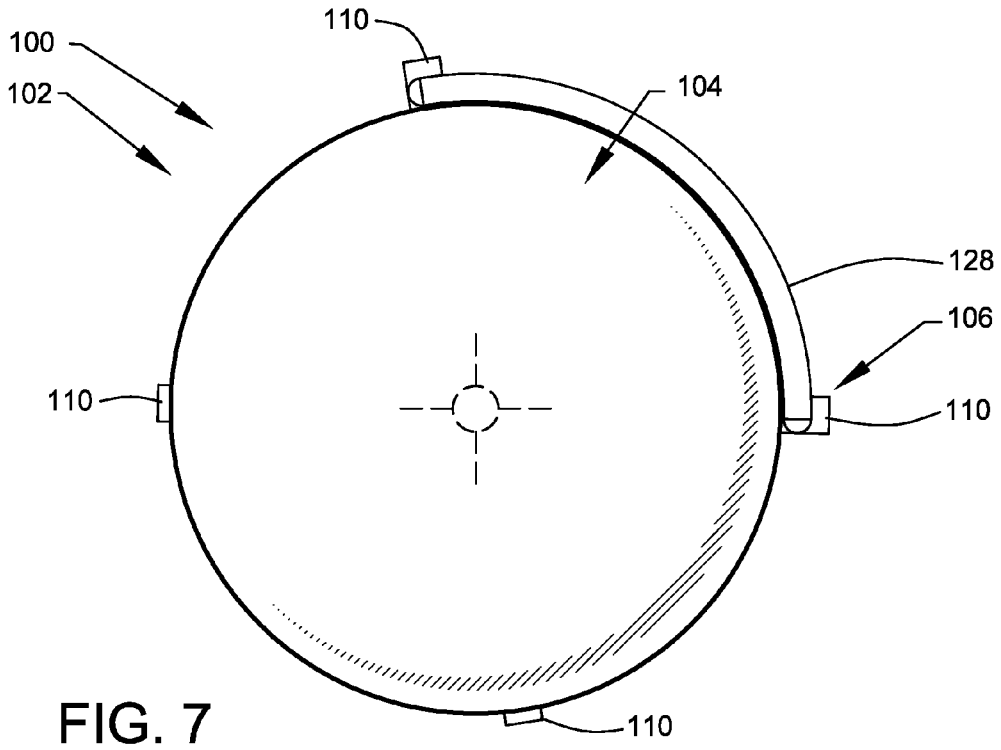
FIG. 7 is a top view of the modular stackable stool of FIG. 1.
Figure 8:
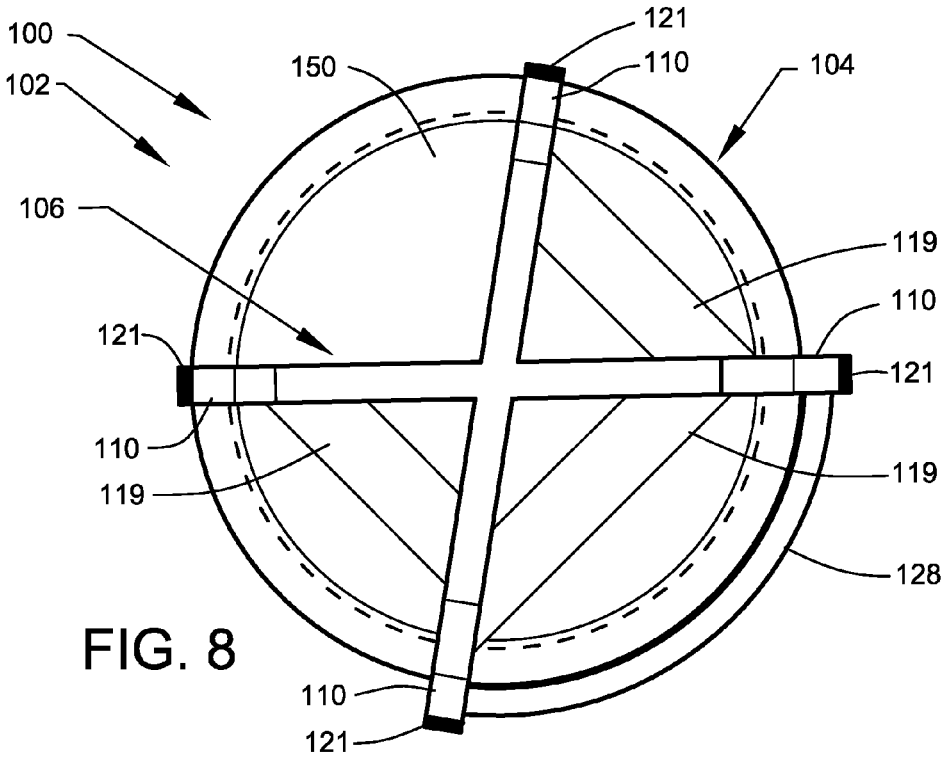
FIG. 8 is a bottom view of the modular stackable stool of FIG. 1.
Figure 9:
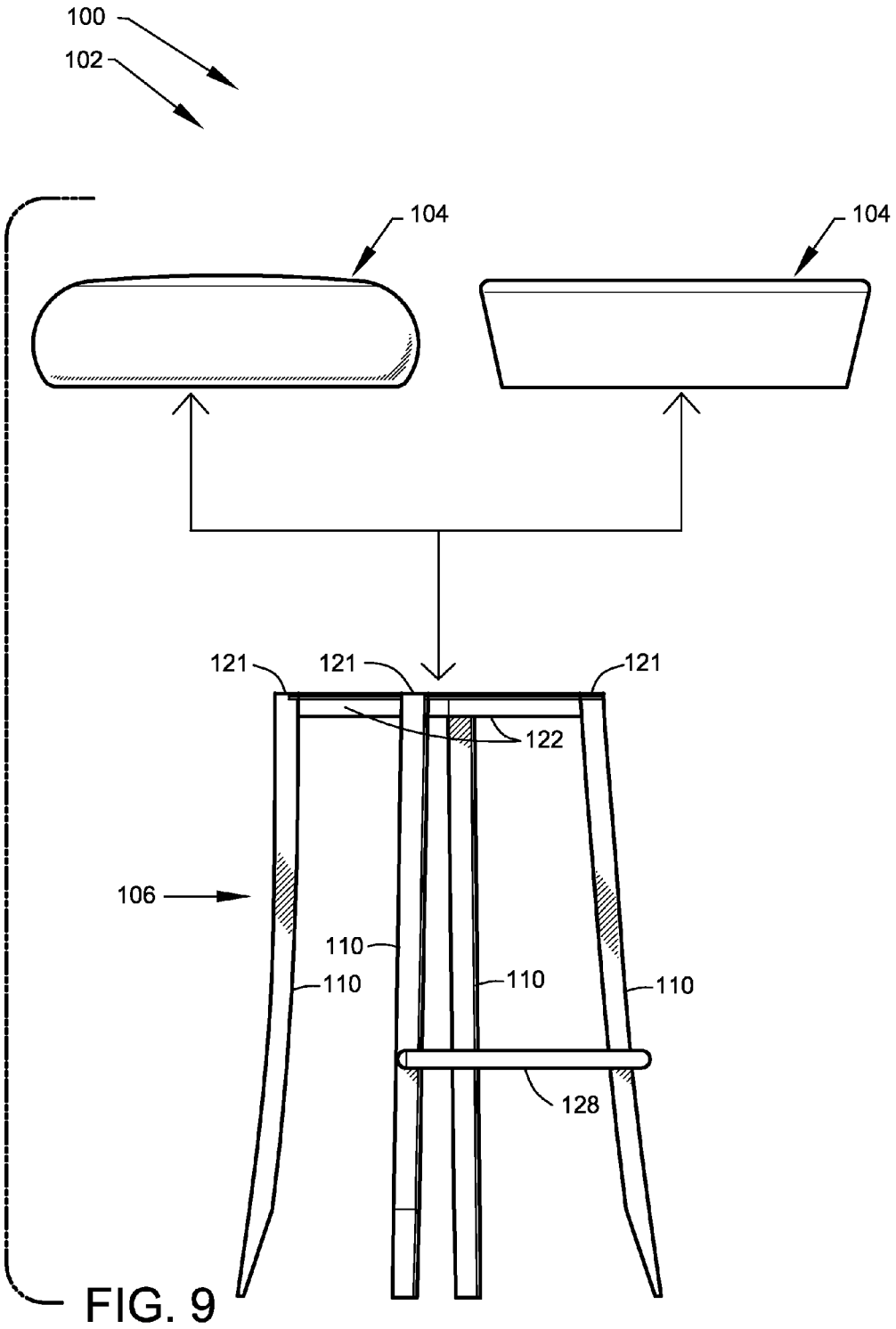
FIG. 9 is a side view of the modular stackable stool with the stool seat removed from the base support according to the preferred embodiment of FIG. 1.
Figure 10:
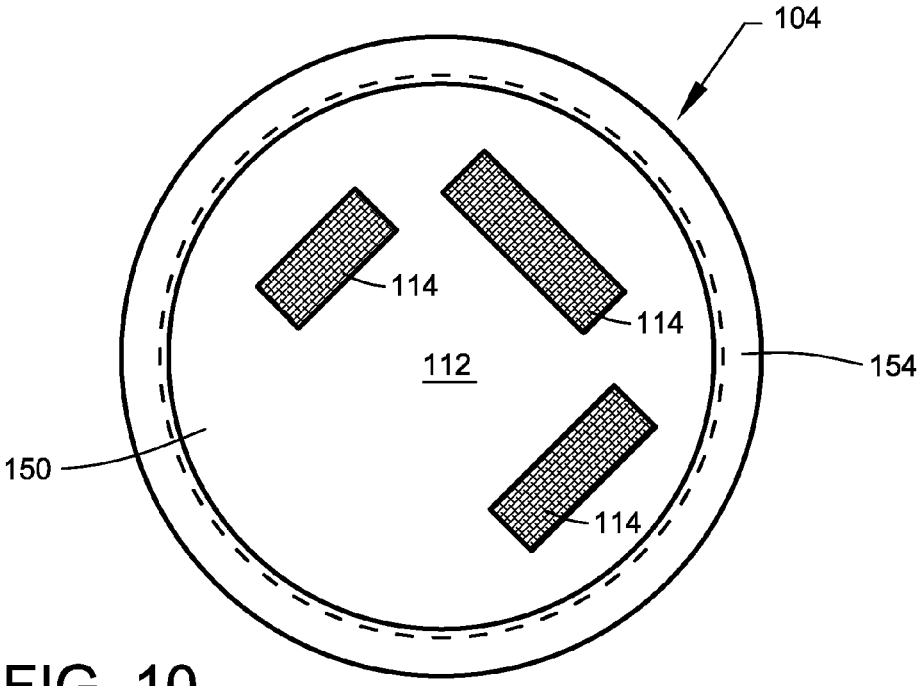
FIG. 10 is bottom view of the stool seat showing an arrangement of couplers used to removeably attach a selected stool seat to a selected stool base support.

FIG. 3 is a front view of the modular stackable stool 102 of FIG. 1. FIG. 4 is a rear view of modular stackable stool 102. FIG. 5 is a right side view of modular stackable stool 102 and FIG. 6 is a left side view thereof. FIG. 7 is a top view of modular stackable stool 102 and FIG. 8 is a bottom view thereof. FIG. 9 is a side view of the modular stackable stool with stool seat 104 removed from the base support according to the preferred embodiment of FIG. 1. FIG. 10 is bottom view of stool seat 104 showing an arrangement of first coupling element 114 used to removeably attach a selected stool seat 104 to a selected stool base 106.

Referring to FIG. 3 and FIG. 10, each stool seat 104 preferably comprises a generally circular member having a cushioned upper portion 108 and an opposing lower surface 112, as shown. Lower surface 112 preferably comprises at least one first coupling element 114 designed to couple with at least one second coupling element 116 of stool bases 106.

Referring to FIG. 3 through FIG. 9, each stool base 106 preferably comprises at least three support legs 110 with the most preferred embodiments of the system comprising four support legs 110, as shown. The lower portions of the support legs 110 are preferably configured to rest stably on a floor or other supportive surface 115, as shown in FIG. 3. Preferably, the upper end portions of support legs 110 are rigidly joined by a set of horizontal cross members, preferably forming a rigid X-shaped upper cross brace 122 linking structurally the four legs, as shown. Three bracing plates 119 are rigidly mounted between the horizontal cross members, to add additional structural rigidity to the cross-brace structure, and to support second coupling elements 116 used to removeably couple stool seat 104 to stool base 106.

Cross brace 122 preferably provides the central structural support of the stool base assembly. As such, it comprises sufficient strength so that no additional bracing (with the exception of a foot rest) is required below the level of stool seat 104. This allows the overall stool to maintain a visually light appearance and further enhances the ability to stack the units during transport and storage.

As shown in FIG. 3, stool bases 106 preferably comprise a preferred stool-base height A of about 26 inches. As shown in FIG. 3 through FIG. 6, each support leg 110 preferably follows a continuous outward curve as it approaches supportive surface 115. The grouping of legs forming lower stool-base portion 118 preferably comprise a maximum contact width B, as measured at supportive surface 115, of about 18 inches.

Preferably, two of support legs 110 are rigidly coupled by a mono-directional foot rest 128, as shown, that is preferably configure to support at least one foot of a user and to rigidly interconnect two of the four support legs, as shown. The term mono-directional is used to indicate that foot rest 128 preferably comprises a single-sided support orientation, rather than 360-degrees of circumferential support.

Foot rest 128 preferably comprises a generally round bar forming a curving arc, as shown. Such curving shape preferably adds additional strength at the widest separation between adjacent legs, as shown. Thus, foot rest 128 preferably functions to resist deformation of the widely-separated front legs 110, which are generally subjected to more bending force than the rear legs 110. Beyond the above-described structural functions, foot rest 128 also provides ergonomic foot support and provides a balanced seated configuration for the user. Foot rest 128 is preferably located at a height C of about 10½ inches above supportive surface 115, as shown.

Support legs 110 of stool bases 106 are preferably constructed from metallic members, preferably steel member, preferably one inch by one inch by 16-gauge cold-rolled tubular steel. The lower about four inches of the legs preferably taper to about a one inch by one-quarter inch contact area. To protect supportive surfaces 115 from damage, one-half inch by one-inch square tube caps 121 are preferably used to finish the lower terminations of the legs. One-inch square tube caps 123 are preferably used to finish the tops of the tubes.

Figure 11:
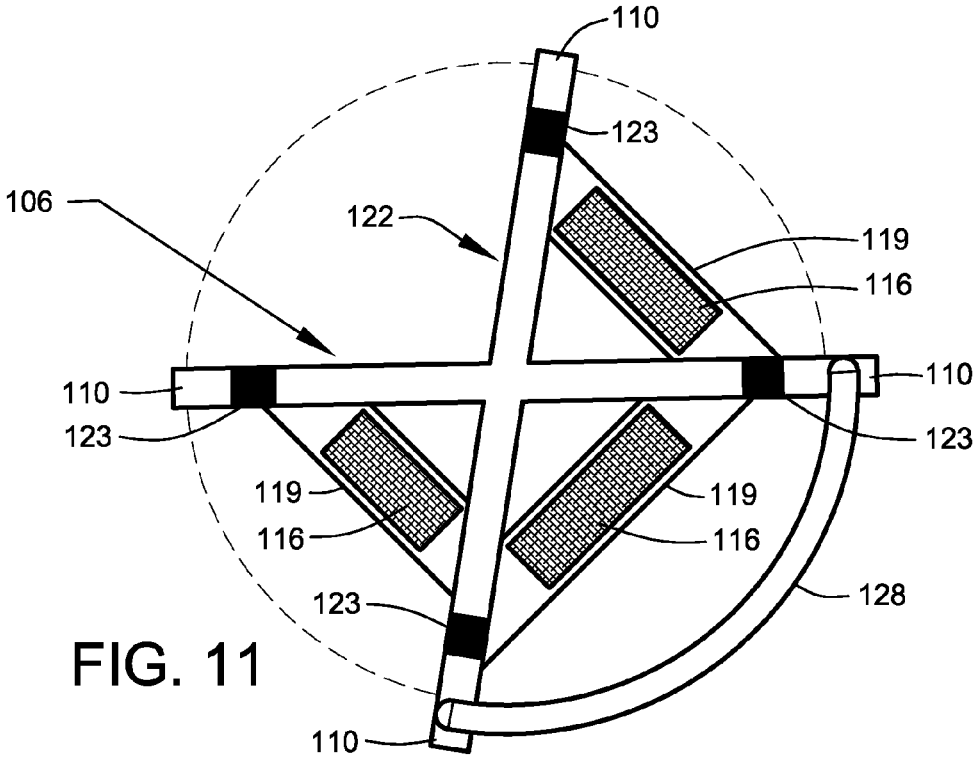
FIG. 11 is a top view of a stool base support showing an arrangement of couplers used to removeably attach a selected stool seat to a selected stool base support.

FIG. 11 is a top view of stool base 106 showing an arrangement of second coupling elements 116 used to removeably attach a selected stool seat 104 to a selected stool base lower surface 112. Crossbar members forming upper cross brace 122 are preferably constructed from ne-half inch by one inch by 16-gauge cold-rolled tubular steel. Alternately preferably, crossbar members forming upper cross brace 122 are preferably constructed from one inch by one inch by 16-gauge cold-rolled tubular steel. Foot rest 128 and support legs 110 are preferably assembled by thermal welding, preferably by Metal Inert Gas (MIG) welding.

Bracing plates 119 preferably comprise ⅛-inch thick by two-inch wide steel plates thermally welded to cross brace 122. Bracing plates 119 are preferably used to support second coupling elements 116, as shown.

In one preferred embodiment of the system, each first coupling element 114 comprises one-half of hook-and-loop fastener 111, which is firmly attached to lower surface 112, as best shown in FIG. 10. In such a preferred embodiment of the system, each second coupling element 116 also comprises one-half of hook-and-loop fastener 111, which is preferably attached to bracing plates 119 joining the X-shaped upper cross brace 122, as shown. When coupled together, first coupling element 114 and second coupling element 116 together form a releasable retainer 124 structured and arranged to assist releasable retention of second coupling element 116 within a first coupling element 114.

Foot rest 128 preferably comprise ¾ inch outside diameter by 16-gauge steel tube. Preferably, foot rest 128 is rigidly joined to support legs 110 by thermal welding, preferably by MIG welding.

Stool bases 106 preferably comprise at least one durable protective finish. In one preferred embodiment of the system, stool bases 106 are preferably finished in powder coat (preferably comprising a thermoplastic or thermoset polymer). Surfaces receiving powder coat are preferably prepared by light media blasting. Those of ordinary skill in the art will appreciate that powder coats are available in many hundreds of standard colors, gloss levels, and textures.

Referred to the partial sectional view of FIG. 3, stool seats 104 preferably comprise a substantially rigid lower base 150 that preferably supports a generally circular pad of resilient foam 152, as shown. At least one upholstery fabric material 154 covers resilient foam 152 and a portion of base 150, as shown (rigid base 150 preferably comprises lower surface 112 and second coupling elements 116). Rigid lower base 150 preferably comprises a ⅝-inch thick Oriented Strand Board (OSB) panel with a 3/16-inch radius formed along the top and bottom periphery of the panel. In one preferred embodiment of the system the pad of resilient foam 152 comprises a thickness of about 5 inches. Upholstery fabric material 154 is preferably secured to lower surface 112 using mechanical fasteners, preferably staples.

In use, a customer/renter will have a choice of one stool base 106 in conjunction with two or more sizes, styles, and geometric configurations of stool seats 104. Preferably, stool seats 104 will be offered in a range of colors, patterns, and styles, thereby affording customers, especially those in the rental field, the ability to readily coordinate "themed" stools 102 with other design elements/themes of an event. Upon reading this specification, those with ordinary skill in the art will now appreciate that, under appropriate circumstances, considering such issues as design preference, user preferences, marketing preferences, cost, structural requirements, available materials, technological advances, etc., other seat arrangements such as, for example, the use of unpadded seats, molded polymer seat materials, etc., may suffice.

Figure 13:
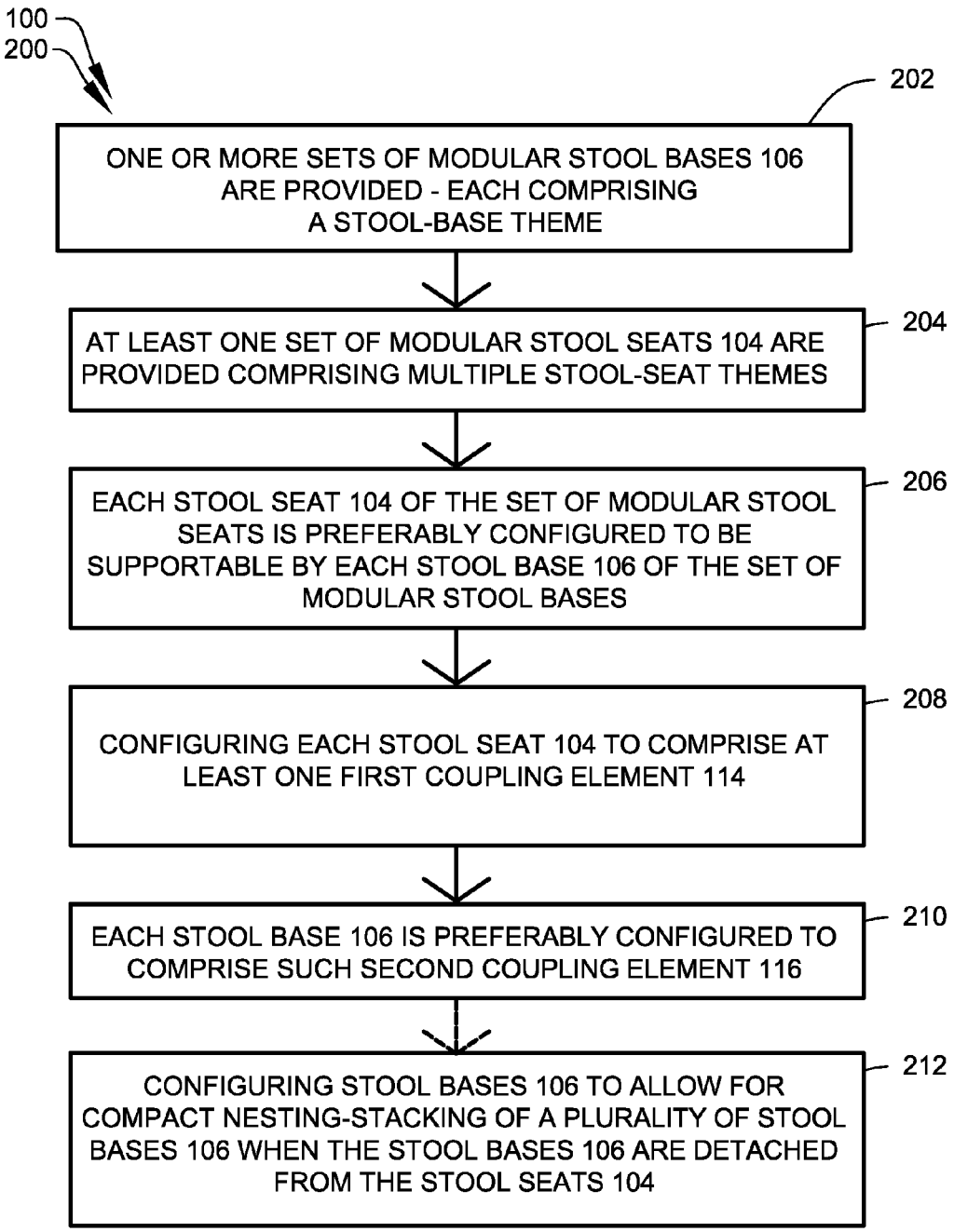
FIG. 13 is a flow diagram, illustrating a preferred method of generating distinctly themed stools from modular stool components, according to preferred methods and embodiments of the present invention.

FIG. 13 is a flow diagram, illustrating preferred method 200 of generating such distinctly themed stools 102 from a small set of modular stool components, according to preferred methods and embodiments of the present invention. In initial preferred step 202 of method 200, at least one set of modular stool bases 106 are provided. As previously described, such set of modular stool bases 106 preferably comprise multiple stool-base themes (that is, colors, textures, etc.) Next, as indicated in preferred step 204, at least one set of modular stool seats 104 are provided comprising multiple stool-seat themes. In subsequent preferred step 206, each stool seat 104 of the set of modular stool seats is preferably configured to be supportable by each stool base 106 of the set of modular stool bases. The system is further enhanced in preferred step 208 by preferably configuring each stool seat 104 to comprise at least one first coupling element 114 structured and arranged to couple with at least one second coupling element 116 of a stool base 106. Thus, as indicated in preferred step 210, each stool base 106 is preferably configured to comprise such second coupling element 116. As previously described, each first coupling element 114, when combined with at least one second coupling element 116, together comprise releasable retainer 124, which preferably assists the previously-described releasable retention of second coupling element 116 with first coupling element 114. In this preferred manner, at least one distinct set of stools 102, comprising a distinct stool theme, may be developed by combining stool seats 104 selected from the set of modular stool seats with stool bases 106 selected from the set of modular stool bases.

In addition, method 200 further comprises the additional preferred step 212 of configuring stool bases 106 to allow for compact nesting-stacking of a plurality of stool bases 106 when the stool bases 106 are detached from the stool seats 104.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A modular stool system relating to modular stool components capable of forming distinct sets of themed stools, said modular stool system comprising:

a) at least one first set of stool bases, each said stool base of said at least one first set of stool bases comprising at least one first common base feature;

b) at least one first set of stool seats, each said stool seat of said at least one first set of stool seats comprising at least one first common seat feature; and c) at least one second set of stool seats, each said stool seat of said at least one second set of stool seats comprising at least one second common seat feature differing from said at least one first common seat feature;

d) wherein each stool seat of said at least one first set of stool seats and said at least one second set of stool seats is configured to be supportable by each said stool base of said at least one first set of stool bases;

e) wherein each said stool seat of said at least one first set of stool seats and each said stool seat of said at least one second set of stool seats comprise at least one first coupling element structured and arranged to releasably couple with at least one second coupling element of at least one said stool base of said at least one first set of stool bases;

f) wherein each said stool base of said at least one first set of stool bases further comprises i) at least three support legs structured and arranged to support, above at least one support surface, a selected one of each said stool seat of said at least one first set of stool seats and each said stool seat of said at least one second set of stool seats, ii) such at least one second coupling element structured and arranged to releasably engage said at least one first coupling element of each said stool seat of either one of said at least one first set of stool seats and said at least one second set of stool seats, and iii) extending between two of said at least three support legs, a mono-directional foot rest configured to support at least one foot of a user; and g) wherein, only when detached from said stool seat, each said stool base of said at least one first set of stool bases allows nesting-stacking with each other said stool base of said at least one first set of stool bases in a vertical direction;

h) wherein said nesting-stacking comprises each support leg of said at least three support legs nesting adjacent each corresponding support leg of another said stool base of said at least one first set of stool bases in an identical horizontal direction relative to the vertical direction of said nesting-stacking; and i) wherein said stool seat, when attached to said stool base resting upon the at least one support surface, is positioned further away from the at least one support surface than any other portion of the themed stool.

2. The modular stool system, according to claim 1, further comprising:

a) at least one second set of stool bases, each said stool base of said at least one second set of stool bases comprising at least one second common base feature differing from said at least one first common base feature;

b) wherein each stool seat of said at least one first set of stool seats and said at least one second set of stool seats is configured to be supportable by each said stool base of either one of said at least one first set of stool bases and each said stool base of said at least one second set of stool bases;

c) wherein each said stool seat of said at least one first set of stool seats and each said stool seat of said at least one second set of stool seats comprise said at least one first coupling element structured and arranged to couple with said at least one second coupling element of at least one said stool base of either one of said at least one first set of stool bases and said at least one second set of stool bases;

d) wherein each said stool base of said at least one second set of stool bases further comprise i) at least three said support legs structured and arranged to support, above such at least one support surface, a selected one of each said stool seat of said at least one first set of stool seats and each said stool seat of said at least one second set of stool seats, ii) said at least one second coupling element structured and arranged to engage said at least one first coupling element of each said stool seat of either one of said at least one first set of stool seats and said at least one second set of stool seats, and iii) extending between two of said at least three support legs, said mono-directional foot rest configured to support the at least one foot of the user; and e) wherein, only when detached from said stool seat, each said stool base of said at least one first set of stool bases allows nesting-stacking with each said stool base of either said at least one first set of stool bases and said at least one second set of stool bases.

3. The modular stool system, according to claim 2, wherein each one of said at least three support legs comprises a continuous curve.

4. The modular stool system, according to claim 3, further comprising four of said at least three support legs.

5. The modular stool system, according to claim 4, wherein said stool seat substantially comprises:

a) at least one substantially rigid base;

b) at least one resilient foam; and c) at least one fabric material at least partially encasing said at least one resilient foam and said at least one substantially rigid base.

6. The modular stool system, according to claim 5, wherein each said stool base is constructed substantially of at least one rigid metallic material.

7. The modular stool system, according to claim 6, wherein said at least one rigid metallic material comprises substantially steel.

8. The modular stool system, according to claim 7, wherein each said stool base comprises a maximum stool-base height of about 26 inches.

9. The modular stool system, according to claim 7, wherein each said stool base comprises a maximum contact width of about 18 inches.

10. The modular stool system, according to claim 7, wherein said at least one first coupling element and said at least one second coupling element comprise at least one hook-and-loop fastener.

11. A method relating to forming distinct sets of themed stools from modular stool components, said method comprising the steps of:

a) providing at least one set of modular stool bases comprising multiple stool-base themes;

b) providing at least one set of modular stool seats comprising multiple stool-seat themes;

c) configuring each stool seat of such at least one set of modular stool seats to be supportable by each such stool base of such at least one set of modular stool bases;

d) configuring each stool seat of such at least one set of modular stool seats to comprise at least one first coupling element structured and arranged to couple with at least one second coupling element of at least one such stool base;

e) configuring each such stool base of such at least one set of modular stool bases to comprise such at least one second coupling element structured and arranged to engage such at least one first coupling element of each such stool seat;

f) configuring each such stool base of such at least one set of modular stool bases to comprise at least three support legs structured and arranged to support, above at least one support surface, a selected one of such at least one set of modular stool seats, g) configuring each such stool base of such at least one set of modular stool bases to comprise, extending between two of said at least three support legs, a mono-directional foot rest configured to support the at least one foot of a user; and h) configuring each such stool base to position each such stool seat, when attached to such stool base resting upon the at least one support surface, further away from the at least one support surface than any other portion of the themed stool;

i) wherein at least one distinct set of stools, comprising a distinct stool theme, may be developed by combining such stool seats selected from such at least one set of modular stool seats with such at least one stool bases selected from such at least one set of modular stool bases;

j) configuring such stool bases to allow for compact nesting-stacking in a vertical direction of a plurality of such stool bases only when such stool bases are detached from such stool seats; and k) wherein nesting-stacking comprises each support leg of said at least three support legs nesting adjacent each corresponding support leg of another said stool base of said at least one first set of stool bases in an identical horizontal direction relative to the vertical direction of said nesting-stacking.

12. A modular stool system relating to modular stool components capable of forming distinct sets of themed stools, said modular stool system comprising:

a) at least one set of modular stool bases comprising multiple stool-base themes;

b) at least one set of modular stool seats comprising multiple stool-seat themes;

c) wherein each stool seat of such at least one set of modular stool seats is configured to be detachably coupled to a selected stool base of such at least one set of modular stool bases;

d) wherein each said stool base comprises i) at least three support legs following a continuous curve, and ii) extending between two of said at least three support legs, a mono-directional foot rest configured to support the at least one foot of a user; and e) wherein said stool seat, when attached to said stool base resting upon at least one support surface, is positioned further away from the at least one support surface than any other portion of the themed stool;

f) wherein at least one distinct set of stools, comprising a distinct stool theme, may be developed by combining such stool seats selected from such at least one set of modular stool seats with such at least one stool bases selected from such at least one set of modular stool bases;

g) wherein, only when detached from said stool seat, each said stool base of such at least one set of modular stool bases allows nesting-stacking with each other such stool base of such at least one set of modular stool bases in a vertical direction; and h) wherein nesting-stacking comprises each support leg of such at least three support legs nesting adjacent each corresponding support leg of another such modular stool base of from such at least one set of modular stool bases in an identical horizontal direction relative to the vertical direction of said nesting-stacking.

13. The modular stool system, according to claim 12, wherein said stool seat substantially comprises:

a) at least one substantially rigid base;

b) at least one resilient foam; and c) at least one fabric material at least partially encasing said at least one resilient foam and said at least one substantially rigid base.

14. The modular stool system, according to claim 12, wherein each said stool base is constructed substantially of at least one rigid metallic material.

15. The modular stool system, according to claim 14, wherein said at least one rigid metallic material comprises substantially steel.

16. The modular stool system, according to claim 12, wherein each said stool base comprises a maximum stool-base height of about 26 inches.

17. The modular stool system, according to claim 12, wherein each said stool base comprises a maximum contact width of about 18 inches.

18. The modular stool system, according to claim 12, further comprising:

a) joined with said stool seat, at least one first releasable coupler; and b) joined with said stool base, at least one second releasable coupler;

c) wherein said at least one first releasable coupler and said at least one second releasable coupler comprise at least one hook-and-loop fastener.

* * * * *